US005092240A

United States Patent [19]

Schumacher

[11] Patent Number: 5,092,240

[45] Date of Patent: Mar. 3, 1992

[54] EASILY REMOVABLE MOUNTING AND DRIVE ASSEMBLY FOR A ROTATING CYLINDER OF A PRINTING UNIT

[75] Inventor: Thomas H. Schumacher, Downers Grove, Ill.

[73] Assignee: WPC Machinery Corporation, Downers Grove, Ill.

[21] Appl. No.: 486,017

[22] Filed: Feb. 28, 1990

[51] Int. Cl.[5] ..... B41F 13/20

[52] U.S. Cl. ..... 101/153; 101/174; 101/216

[58] Field of Search ..... 101/216, 174, 153, 348, 101/349, 212; 100/172

[56] References Cited

U.S. PATENT DOCUMENTS

| | | | |
|---|---|---|---|
| 2,778,362 | 1/1957 | Reinartz | 101/216 |
| 3,039,387 | 6/1962 | Zimmer et al. | 101/216 |
| 4,262,590 | 4/1981 | Bruckner | 101/216 |
| 4,271,760 | 6/1981 | Corse | 101/142 |
| 4,308,796 | 1/1982 | Satterwhite | 101/143 |
| 4,391,191 | 7/1983 | Bozza-Schunemann | 100/216 |
| 4,620,480 | 11/1986 | Hermach | 101/179 |
| 4,759,286 | 7/1988 | Witczack | 101/216 |
| 4,796,452 | 1/1989 | Schiel | 101/172 |
| 4,807,527 | 2/1989 | Knauer | 101/216 |
| 4,915,024 | 4/1990 | Wanke | 100/172 |
| 4,953,462 | 9/1990 | Krober | 101/216 |

*Primary Examiner*—Edgar S. Burr
*Assistant Examiner*—John S. Hilten
*Attorney, Agent, or Firm*—Welsh & Katz, Ltd.

[57] ABSTRACT

A mounting and drive assembly which is designed to easily, rapidly and accurately remove and replace a cylinder such as a transfer cylinder of a gluing unit that may be provided in associated with a web printing press.

13 Claims, 2 Drawing Sheets

EASILY REMOVABLE MOUNTING AND DRIVE ASSEMBLY FOR A ROTATING CYLINDER OF A PRINTING UNIT

The present invention generally relates to a mounting and drive assembly for a rotating cylinder of a printing press, and more particularly relates to such an assembly for easily installing and removing a transfer cylinder, for example, of a unit that applies glue or other materials to a moving web in a printing operation.

Printing establishments which perform printing operations on a generally continuously moving web often have a need to apply glue or other material to the web for various reasons. Certain operations require application of glue to only a small portion of the width of the web, such as may required to apply glue to a flap of an envelope, for example. Also, different jobs require different positioning of the glue, and it is therefore necessary to remove a traditional transfer cylinder and replace it with a segmented transfer cylinder which can apply different materials at the same time.

It has been difficult and time consuming to remove traditional transfer cylinders and replace them with segmented transfer cylinders in the past, because most gluers had the bearings of the transfer cylinders mounted in bores of the side frames of the machine, and it was necessary to perform major dismantling of the machine to remove the transfer cylinder. In this regard, there are usually a train of several cylinders that are associated with such machines, and the side frames are the major structural support for most all of such cylinders. Accordingly, depending upon the number of cylinders involved, it should be appreciated that removal of one transfer cylinder and replacing it with another may require a large amount of work, requiring considerable time.

It is also known in the printing art, that the time required to make such a change over represents down time for the press, and results in significant costs in terms of lost production.

Accordingly, it is a primary object of the present invention to provide an improved mounting and drive assembly for cylinders such as transfer cylinders, which assembly permits easy and fast removal and replacement of transfer cylinders without dismantling the side frames of the unit in which such cylinders are installed.

It is another object of the present invention to provide such an improved assembly which positions the cylinder bearings closer to the ends of the transfer cylinder itself relative to the side frames of the machine in which it is installed, which positioning results in less deflection of the transfer cylinder and therefore more accurate thicknesses of glue or other materials being applied by the transfer cylinder to the web.

Yet another object of the present invention lies in the provision for such assembly to be accurately positioned as well as easily removed and installed.

Another object of the present invention is to provide such an improved assembly which can be inexpensively manufactured, and requires little modification of other parts of the unit in which it is installed.

These and other objects will become apparent upon reading the following detailed description of the present invention, while referring to the attached drawings, in which:

FIG. 1 is a plan view of the drive end mounting assembly, and is shown partially in section and with a portion of the cylinder which it carries as well as with a portion of the side frame of a gluing machine; and, FIG. 2 is a plan view of the opposite end mounting assembly, and is also shown partially in section and with a portion of the cylinder which it carries as well as with a portion of the other side frame of a gluing machine.

DETAILED DESCRIPTION

Broadly stated, the present invention is directed to a mounting and drive assembly which is designed to easily, rapidly and accurately remove and replace a cylinder such as a transfer cylinder of a gluing unit. However, it should be understood that it is not limited to such a specific application, for the mounting and drive assembly may be utilized in printing units of many types, where rapid and easy removal of a cylinder is desired without dismantling the side frames of such a unit.

Figure 1:
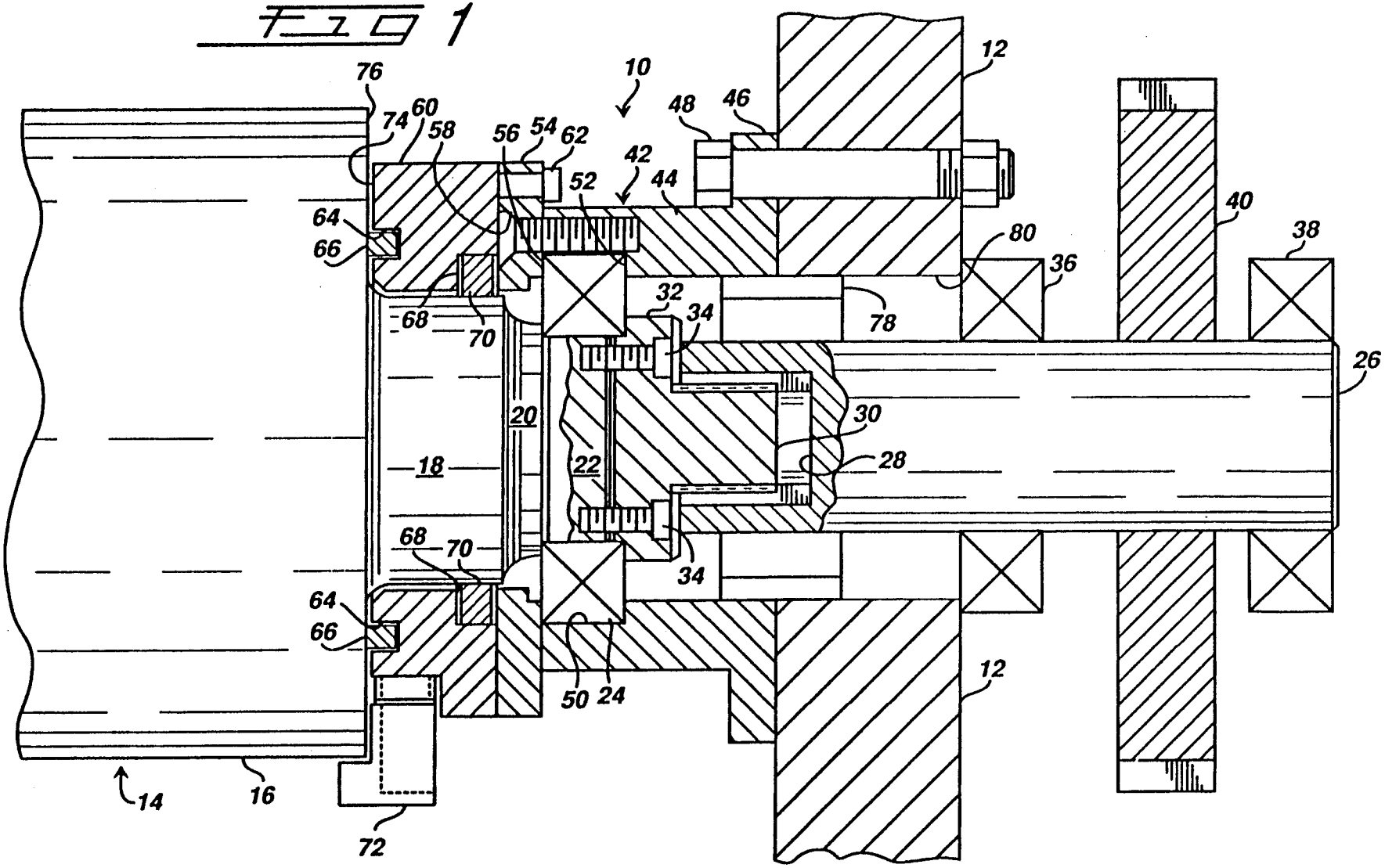
Figure 2:
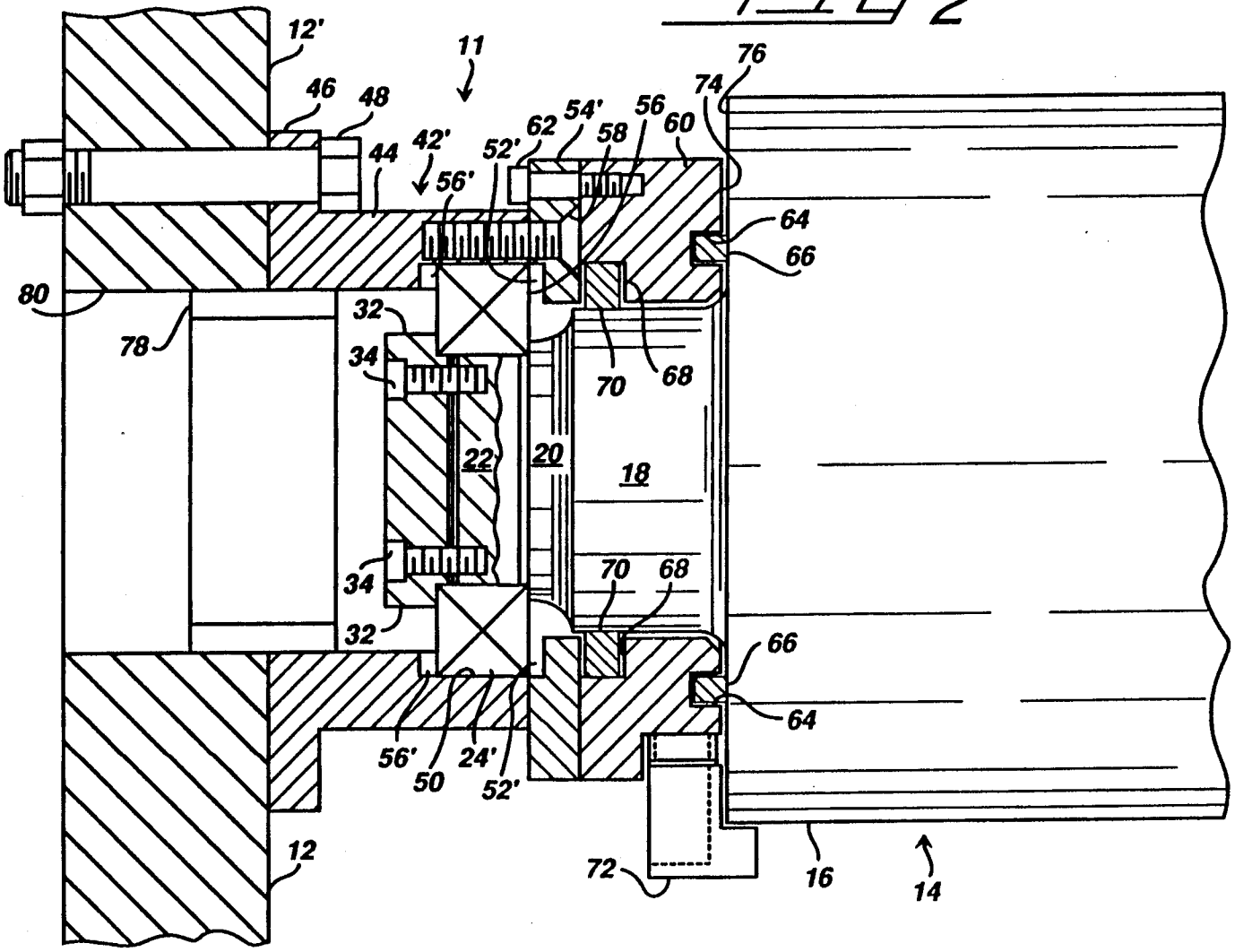

Turning now to the drawings, the operator side of the mounting and drive assembly is illustrated in FIG. 1 and the machine or opposite side is shown in FIG. 2. The structure of the assembly has many common components on both sides, as will be apparent. In those instances where the component is shown on one side and a complementary component is shown on the opposite side, common reference numbers are applied. In those instances where a component is shown on one side and a similar component is shown on the opposite side, the opposite side similar component will be given common reference numbers, with the similar component also have the designator "'" combined with the reference number.

Referring to FIG. 1, the drive side mounting and drive subassembly, indicated generally at 10, is illustrated in assembled position, attached to the side frame 12 of the drive side and carries one end of a transfer cylinder 14 that has a cylindrical outer surface which is adapted to apply glue or other material to another cylinder in a train of cylinders or rolls. Referring to FIG. 2, there is another mounting subassembly 11 located on the opposite end of the transfer cylinder 14 in association with another side frame 12'. The cylinder 14 has an integral smaller cylindrical portion 18, an integral transition portion 20 and an integral cylindrical end portion 22 having an outer surface which fits into the inner race (not shown, but which is conventional) of a cylindrical bearing 24 which also has an outer race (not shown).

The transfer cylinder 14 is driven by a removable drive shaft 26, the left end (as shown in the drawing) of which has a generally cylindrical recess 28 that has a complementary female spline configuration aligned in the axial direction to receive the splines of a drive stub shaft 30 that has an enlarged cylindrical flange that is suitably bolted to the end surface of the end portion 22 of the transfer cylinder 14 by bolts 34. The drive shaft 26 can be easily removed by pulling the same to the right and it will separate from the splined stub shaft 30. The stub shaft 30 is of sufficient length so that it engages the female spline configuration of the drive shaft 26, but should not be so long that the outer end thereof extends beyond the plane of the left side of the side frame 12. This permits the assemblies 10 and 11, together with the transfer cylinder 14 to be removed when the bolts 48 are removed.

The drive shaft 26 is journaled in a drive structure having bearings 36 and 38 and a drive gear 40. The drive structure is not a part of the present invention, inasmuch as it is conventional and is a part of the structure of the gluing machine in which the present invention is provided. However, for obvious reasons, the construction of the drive structure must be compatible with the present invention in that it must be either removable with the removal of the drive shaft 26 or it must permit the removal of the drive shaft 26.

The subassembly 10 has a bearing housing insert 42 that has cylindrical main portion 44 with an outer flange 46 that is bolted to the side frame 12 by preferably three bolts 48 that are preferably equally spaced around the periphery of the flange 46. The inner left end of the main portion has an enlarged inside diameter 50 adapted to receive the outer race of the bearing 24, and an annular shoulder 52 is thereby defined which bears against the outer race to hold the same firmly. The subassembly 10 also has a cylindrically shaped bearing retaining cap 54, the rightward face of which bears against the left side of the outer race of the bearing 24 at 56. The combination of the retaining cap 54 and the shoulder 52 retains the bearing firmly as is desired.

In accordance with an important aspect of the present invention, and referring to FIG. 2, the structure of the bearing housing insert 42' and of the retaining cap 54' of the subassembly 11 is modified so that the bearing 24 of the assembly can move in the axial direction of the transfer cylinder 14. This permits the length of the combination of the transfer cylinder 14, the subassembly 10 and 11 within the inside surfaces of the side frames 12 and 12' to be varied so that the combination can be shortened to remove the combination, and to be lengthened so that it can be bolted to the side frames.

To this end, and again referring to FIG. 2, the shoulder 52' is spaced from the outside race of the bearing 24 by approximately 1/32 inches, and the retaining cap 54' has an annular portion removed adjacent the other side of the outer race of the bearing so that there is another comparable space between the retaining cap and the bearing 24 as shown at 56'. The spacing on both sides of the outer race of the bearing 24 permits the adjustment of the overall length of the combination of the transfer cylinder 14, the subassembly 10 and 11 so that it can be removed and installed.

The retaining cap 54 is bolted to the end of the cylindrical portion 44 by preferably three screws 58. A cylindrical housing 60 is also provided and is bolted to the bearing retaining cap 54 by preferably three bolts 62.

The housing is of split two-piece design to facilitate removal, and the inside diameter of the same is slightly larger than the transfer cylinder portion 18 so that the latter can freely rotate. The housing 60 has a first pocket 64 for receiving a seal 66 and another pocket 68 which retains another seal 70. Since the transfer cylinder may apply glue, the glue may migrate to the end of the cylinder and seal 66 represents the primary seal to keep glue from traveling into the bearing 24, and the seal 70 represents a secondary seal for prohibiting such travel. A Delrin or teflon wiper 72 may also be provided to wipe glue from the transfer cylinder as it approaches the end of the cylinder 14. It is stationarily positioned near the bottom side of the cylinder so that glue will fall downwardly as it is wiped from the cylinder.

In accordance with an important aspect of the present invention, the end face 74 of the housing 60 adjacent the transfer cylinder end face 76 is spaced approximately 1/32 inches from the transfer cylinder end face 76 to facilitate removal of the subassembly 10 and transfer cylinder 16 from the unit to which it is installed. While the subassembly 10 shown in FIG. 1 is constructed such that there can be no movement of the housing 60 relative to the transfer cylinder 14, as shown in FIG. 2, the ability of the bearing 24' to move relative to the bearing housing insert 42' and retaining cap 54' in the axial direction of the transfer cylinder 14 enables the assembly 10 to move toward the transfer cylinder 14 by the amount of the 1/32 inch so that the housing inserts 42 and 42' can be separated from their associated side frames 12 and 12' and the entire subassemblies 10 and 11, together with the transfer cylinder 14 can be easily removed when the bolts 48 are removed.

To accurately position the subassemblies 10 and 11, each is proved with a positioning sleeve 78 which has an outside diameter that is only slightly smaller than the inside diameter of a bore 80 in the side frame and of the inside diameter of the bearing housing inserts 42 and 42'. When the subassemblies 10 and 11 are to be installed, they are placed in position and the sleeves 78 are slid into the bore 80 and into the bearing housing insert 42 and insert 42', respectively. This precisely positions the housing inserts 42 and 42'relative to the side frames 12 and 12', respectively, and the bolts 48 can then be inserted and tightened. After the bolts 48 are tightened to the desired torque, the sleeves 78 serve no real functional purpose and could be removed if desired, but are preferably not, because there is no need or advantage to do so. It should also be understood that means other than the sleeve 78 may be used to position the housing inserts, if desired.

From the foregoing, it should be appreciated that an improved mounting and drive assembly has been shown and described, which offers many unique and desireable attributes, including the ability to quickly, easily and accurately remove a cylinder without disturbing the side frames of the unit in which it is installed. Similarly, a different transfer cylinder can be similarly easily replaced in a comparable manner. Moreover, the assembly is relatively simple in the sense that it requires a relatively few number of additional components compared to prior art assemblies, and is therefore not significantly more expensive to manufacture, and yet offers many advantages in terms of its efficiency and effectiveness.

While various embodiments of the present invention have been shown and described, it should be understood that various alternatives, substitutions and equivalents can be used, and the present invention should only be limited by the claims and equivalents thereof.

Various features of the present invention are set forth in the following claims.

What is claimed is:

1. A mounting and drive assembly for releasably installing an elongated rotatable cylinder, such as a transfer cylinder of a unit in a printing operation of the type which has two side frames to which said transfer cylinder is operably mounted, wherein the rotatable cylinder has an elongated cylindrically shaped outer surface and at least one reduced diameter portion on each end thereof, at least one of the side frames having a drive aperture through which a drive shaft may pass for rotating the cylinder, said assembly comprising:

a first mounting subassembly adapted to be removably attached to the inside of one of the two side frames, and having a bearing means with inner and outer races, one of said races being in contact with said rotatable cylinder to enable rotation of said cylinder relative thereto;

a second mounting subassembly adapted to be removably attached to the inside of the other of the two side frames, and having a bearing means with inner and outer races, one of said races being in contact with said rotatably cylinder to enable rotation of said cylinder relative thereto;

at least one of said first and second mounting subassemblies being moveable in the axial direction relative to the side frame and said rotatable cylinder by a predetermined distance sufficient to permit the first and second subassemblies and the transfer cylinder to be removed from the side frames as a single unit, each said moveable subassembly defining a predetermined spacing on both sides of the corresponding bearing means for permitting said axial movement of said subassembly;

a stub shaft means attached to at least one end of the rotatable cylinder and having spline means for engaging a drive shaft means for rotating the cylinder, drive shaft means having a configuration adapted to interact with said spline means to rotate said cylinder, said drive shaft means being moveable in the axial direction of the cylinder so that it can be removed from the cylinder.

2. An assembly as defined in claim 1 wherein said stub shaft means extends from the end of the cylinder adjacent the drive aperture of the side wall, said stub shaft means being of a length such that the outer end thereof is spaced from the plane of the inside surface of the adjacent side wall.

3. An assembly as defined in claim 1 wherein said first mounting subassembly includes a housing insert means having a generally cylindrically shaped main portion with an outer annular flange adapted to be removably attached to the inside of the adjacent side frame, the cylindrically shaped portion having a larger inside diameter segment for receiving said bearing means near the cylinder and defining a radial shoulder adapted to contact one side of the outer race of said bearing means and means for removably attaching said housing insert means to the adjacent side frame.

4. An assembly as defined in claim 3 wherein each of the side frames have a plurality of threaded apertures and said shoulder having a plurality of apertures, said attaching means comprises a plurality of bolts which are inserted through said shoulder apertures and threaded into the threaded apertures of the side frame.

5. An assembly as defined in claim 1 wherein said second mounting subassembly includes a housing insert means having a generally cylindrically shaped main portion with an outer annular flange adapted to be removably attached to the inside of the adjacent side frame, the cylindrically shaped portion having a larger inside diameter segment for receiving said bearing means near the cylinder and defining a radial shoulder adapted to contact one side of the outer race of said bearing means and means for removably attaching said housing insert means to the adjacent side frame.

6. An assembly as defined in claim 3 wherein one of said subassemblies includes a generally cylindrically shaped bearing retainer cap attached to said cylindrically shaped main portion of said housing insert means adapted to engage the opposite end of the outer race of said bearing means, the axial length of said larger inside diameter segment being substantially equal to the width of said bearing means, so that the combination of said radial shoulder and said retainer cap holds said bearing means, the diameter of larger inside diameter segment being slightly in excess of the outside diameter of said bearing means.

7. An assembly as defined in claim 6 wherein the other of said subassemblies includes a generally cylindrically shaped bearing retainer cap attached to said cylindrically shaped main portion of said housing insert means, said retainer cap having an enlarged inside diameter portion adjacent the opposite end of the outer race of said baring means associated with the other of said subassemblies to permit limited axial movement of the bearing means relative to said retainer cap, the axial length of said larger inside diameter segment being slightly larger than the width of said bearing means, so that the combination of said radial shoulder and said retainer cap permits limited axial movement of said bearing means relative to said housing insert means and said retainer cap, the diameter of larger inside diameter segment being slightly in excess of the outside diameter of said bearing means.

8. An assembly as defined in claim 3 wherein each of the side frames have a circular aperture concentric with and having the same diameter as the inside diameter of each of said housing insert means, said assembly including a circular sleeve for each subassembly, said sleeve having an outside diameter approximately equal to the inside diameter of the associated housing insert means, so that each of said subassemblies can be accurately positioned during installing of said assembly.

9. A mounting and drive assembly for releasably installing an elongated rotatable cylinder, such as a transfer cylinder of a unit in a printing operation of the type which has two side frames to which said transfer cylinder is operably mounted, wherein the rotatable cylinder has an elongated cylindrically shaped outer surface and at least one reduced diameter portion on each end thereof, at least one of the side frames having a drive aperture through which a drive shaft may pass for rotating the cylinder, said assembly comprising:

a first mounting subassembly including a generally cylindrically shaped housing insert portion having an outer transverse annular flange adapted to be removably attached to the inside of one of the two side frames, and having a bearing means with inner and outer races, said inner race being in contact with said rotatable cylinder to enable rotation of said cylinder relative thereto;

a second mounting subassembly including a generally cylindrically shaped housing insert portion having an outer transverse annular flange adapted to be removably attached to the inside of the other of the two side frames, and having a bearing means with inner and outer races, one of said races being in contact with said rotatable cylinder to enable rotation of said cylinder relative thereto;

one of said first and second mounting subassemblies being moveable in the axial direction of the cylinder relative to the side frame and said rotatable cylinder by a predetermined distance sufficient to permit the first and second subassemblies and the transfer cylinder to be removed from the side frames as a single unit, said housing insert of said moveable subassembly configured to define a predetermined spacing on one side of the corresponding bearing means, and said moveable subassembly defining a predetermined spacing on the other side of said bearing means for permitting said axial movement of said subassembly;

a stub shaft means attached to at least one end of the rotatable cylinder and having means for engaging a drive shaft means for rotating the cylinder, drive shaft means having a configuration adapted to interact with said engaging means to rotate said cylinder, said drive shaft means being moveable in the axial direction of the cylinder so that it can be removed from the cylinder.

10. An assembly as defined in claim 9 wherein the cylindrically shaped portion having a larger inside diameter segment for receiving said bearing means near the cylinder and defining a radial shoulder adapted to contact one side of the outer race of said bearing means and means for removably attaching said housing insert means to the adjacent side frame.

11. An assembly as defined in claim 10 wherein each of the side frames have a circular aperture concentric with and having the same diameter as the inside diameter of each of said housing insert means, said assembly including a circular sleeve for each subassembly, said sleeve having an outside diameter approximately equal to the inside diameter of the associated housing insert means, so that each of said subassemblies can be accurately positioned during installing of said assembly.

12. A mounting and drive assembly for releasably installing an elongated rotatably cylinder, such as a transfer cylinder of a unit in a printing operation of the type which has two side frames to which said transfer cylinder is operably mounted, wherein the rotatably cylinder has an elongated cylindrically shaped outer surface and at least one reduced diameter portion on each end thereof, at least one of the side frames having a drive aperture through which a drive shaft may pass for rotating the cylinder, said assembly comprising:

a first mounting subassembly adapted to be removably attached to the inside of one of the two side frames, and having a bearing means with inner and outer races, one of said races being in contact with said rotatably cylinder to enable rotation of said cylinder relative thereto;

said first mounting subassembly including a housing insert means having a generally cylindrically shaped main portion with an outer annular flange adapted to be removably attached to the inside of the adjacent side frame, the cylindrically shaped portion having a larger inside diameter segment for receiving said bearing means near the cylinder and defining a radial shoulder adapted to contact one side of the outer race of said bearing means and means for removably attaching said housing insert means to the adjacent side frame;

a second mounting subassembly adapted to be removably attached to the inside of the other of the two side frames, and having a bearing means with inner and outer races, one of said races being in contact with said rotatable cylinder to enable rotation of said cylinder relative thereto;

one of said subassemblies including a generally cylindrically shaped bearing retainer cap attached to said cylindrically shaped main portion of said housing insert means adapted to engage the opposite end of the outer race of said bearing means, the axial length of said larger inside diameter segment being substantially equal to the width of said bearing means, so that the combination of said radial shoulder and said retainer cap holds said bearing means, the diameter of the larger inside diameter segment being slightly in excess of the outside diameter of said bearing means;

one of said first and second mounting subassemblies being moveable relative to the side frame and said rotatably cylinder by a predetermined distance sufficient to permit the first and second subassemblies and the transfer cylinder to be removed from the side frames as a single unit, said moveable subassembly including a generally cylindrically shaped bearing retainer cap attached to said cylindrically shaped main portion of said housing insert means, said retainer cap having an enlarged inside diameter portion adjacent the opposite end of the outer race of said bearing means associated with the other of said subassemblies to permit limited axial movement of the bearing means relative to said retainer cap, the axial length of said larger inside diameter segment being slightly larger than the width of said bearing means, so that the combination of said radial shoulder and said retainer cap permits limited axial movement of said bearing means relative to said housing insert means and said retainer cap, the diameter of larger inside diameter segment being slightly in excess of the outside diameter of said bearing means;

a stub shaft means attached to at least one end of the rotatable cylinder and having spline means for engaging a drive shaft means for rotating the cylinder;

drive shaft means having a configuration adapted to interact with said spline means to rotate said cylinder, said drive shaft means being moveable in the axial direction of the cylinder so that it can be removed from the cylinder.

13. An assembly as defined in claim 12 wherein each of the side frames having a circular aperture concentric with and having the same diameter as the inside diameter of each of said housing insert means, said assembly including a circular sleeve for each subassembly, said sleeve having an outside diameter approximately equal to the inside diameter of the associated housing insert means, so that each of said subassemblies can be accurately positioned during installing of said assembly.

* * * * *